US009717964B2

(12) United States Patent
Halpin

(10) Patent No.: US 9,717,964 B2
(45) Date of Patent: Aug. 1, 2017

(54) GOLF PUTTER WITH CONFIGURABLE POWERED ACCESSORIES

(71) Applicant: Sean P. Halpin, Rochester Hills, MI (US)

(72) Inventor: Sean P. Halpin, Rochester Hills, MI (US)

( * ) Notice: Subject to any disclaimer, the term of this patent is extended or adjusted under 35 U.S.C. 154(b) by 0 days.

(21) Appl. No.: 14/600,748

(22) Filed: Jan. 20, 2015

(65) Prior Publication Data

US 2015/0202505 A1 Jul. 23, 2015

Related U.S. Application Data

(60) Provisional application No. 61/929,236, filed on Jan. 20, 2014.

(51) Int. Cl.

| | |
|---|---|
| ***A63B 53/14*** | (2015.01) |
| ***A61H 23/02*** | (2006.01) |
| ***A63B 53/00*** | (2015.01) |
| ***A63B 57/00*** | (2015.01) |
| ***A63B 71/06*** | (2006.01) |

(52) U.S. Cl.

CPC ..... *A63B 53/14* (2013.01); *A61H 23/0263* (2013.01); *A63B 53/007* (2013.01); *A63B 57/00* (2013.01); *A61H 2201/0153* (2013.01); *A63B 2071/0655* (2013.01)

(58) Field of Classification Search

CPC ..... A63B 53/14; A63B 24/00; A63B 71/06

See application file for complete search history.

(56) References Cited

U.S. PATENT DOCUMENTS

| | | | | |
|---|---|---|---|---|
| 4,904,834 | A * | 2/1990 | Bowen | H05B 6/64 219/726 |
| 4,930,785 | A * | 6/1990 | Mills | A63B 69/3632 473/202 |
| 6,988,954 | B1 * | 1/2006 | Buell | A01D 34/90 30/276 |
| 7,125,340 | B1 * | 10/2006 | Priester | A63B 69/3623 473/223 |
| 8,550,654 | B2 * | 10/2013 | Olsen | F41B 15/022 362/102 |
| 2007/0195521 | A1 * | 8/2007 | Rosiello | F21L 4/00 362/202 |
| 2011/0227500 | A1 * | 9/2011 | West | F21L 4/027 315/287 |

* cited by examiner

*Primary Examiner* — Gene Kim
*Assistant Examiner* — Jeffrey Vanderveen
(74) *Attorney, Agent, or Firm* — Lorenz & Kopf, LLP

(57) ABSTRACT

A novelty golf club in the form of a putter is disclosed. A conventional putter is adapted to include a battery assembly disposed in the grip end of a club shaft. The battery assembly includes a set of batteries arranged end to end. A pair of terminals are configured at the battery assembly adjacent a first coupling element. A powered accessory has a second coupling element which cooperates with the first coupling element to releasably secure the powered accessory to the battery assembly. A variety of powered accessories, such as a fan assembly, a mixer assembly, a string trimmer assembly, a vibrating massager, a flashlight, and a charging unit are configured for the novelty golf club.

20 Claims, 5 Drawing Sheets

GOLF PUTTER WITH CONFIGURABLE POWERED ACCESSORIES

CROSS-REFERENCE TO RELATED APPLICATIONS

This application claims the benefit of U.S. Provisional Application No. 61/929,236, filed on Jan. 20, 2014. The entire disclosure of the above application is incorporated herein by reference.

FIELD

The present disclosure relates to a novelty golf club and more specifically to a putter having a battery assembly disposed at the grip end of the club with various powered accessories that may be releasably connected to the putter so that power is provided by the battery assembly.

BACKGROUND

This section provides background information related to the present disclosure which is not necessarily prior art.

Golf is a sports enjoyed by millions of people. In general, golf requires a level of concentration which over time can detract from the enjoyment of playing the sport. While the sport is played competitively, more often it is played in a recreational and social manner. As a result, novelty golfing products are common place and represent very marketable merchandise.

There are a wide variety of novelty golfing merchandise including equipment, apparel, printed material, games, etc. In the class of novelty equipment, the merchandise frequently has little to no functionality for playing the game of golf. The present disclosure combines certain novelty aspects of a golf club with the functional aspects thereof for providing a product that is usable for playing golf, while at the same time having an amusing or entertaining aspect which may or may not have an ancillary purpose for the game.

SUMMARY

This section provides a general summary of the disclosure, and is not a comprehensive disclosure of its full scope or all of its features.

A novelty golf club is disclosed. The golf club has a tubular shaft with a club head disposed on one end of the shaft and a grip disposed on an end opposite the club head. The battery assembly includes a sleeve disposed within the tubular shaft and has a first coupling element extending from the grip end of the shaft. A set of batteries, preferably 6 AAA cell batteries, are arranged end to end in the sleeve and coupled in series so that a positive terminal of the top battery is exposed at the coupling element. An electrical connector extends from a negative terminal of the bottom battery along the sleeve and terminates adjacent to the positive terminal of the top battery.

A powered accessory has a second coupling element which cooperates with the first coupling element to releasably secure the powered accessory to the battery assembly. Several powered accessories are described herein with various functions and configuration for use with the novelty golf club. For example, the powered accessory selected may include a fan assembly, a mixer assembly, a string trimmer assembly, a vibrating massager, a flashlight, and a charging unit. The novelty golf club may also include a cap having a third coupling element which cooperates with the first coupling element to cover the battery assembly when a powered accessory is not in place, thereby rendering the club legally playable in accordance with the rules of golf. The novelty golf club may be sold with a single powered accessory or as a kit with a plurality of powered accessories.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

FIG. 5 is a detail similar to FIG. 4 with a powered accessory having a spin collar attached to the first coupling element and a spin cap for rotatably support various rotary powered accessories such as a fan assembly, a mixer assembly, a string trimmer assembly and the like;

Corresponding reference numerals indicate corresponding parts throughout the several views of the drawings.

DETAILED DESCRIPTION

Figure 1:
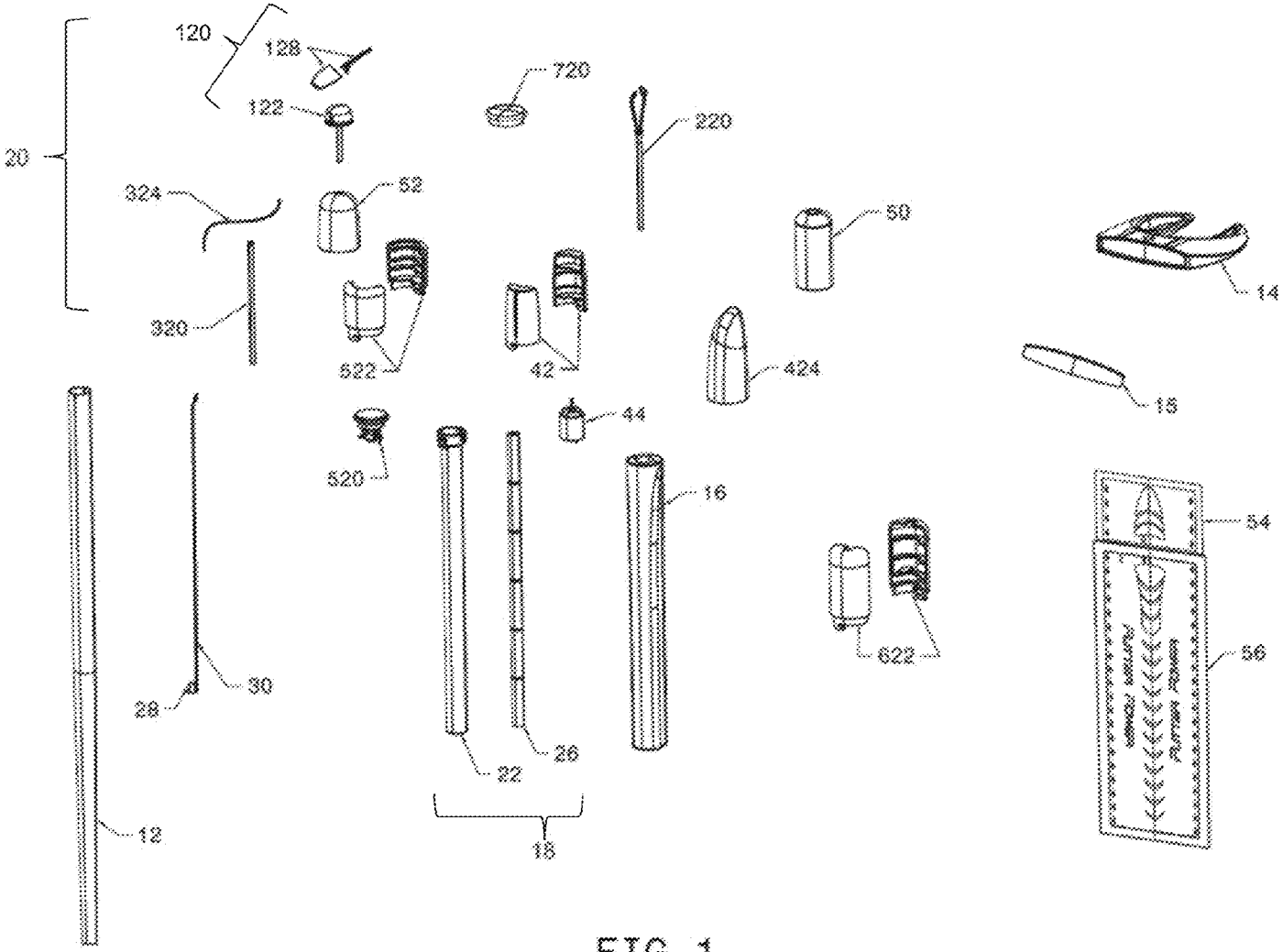
FIG. 1 is an exploded perspective view of the novelty golf club illustrating the battery assembly as well as a variety of powered accessories and a play cap.
Figure 3:
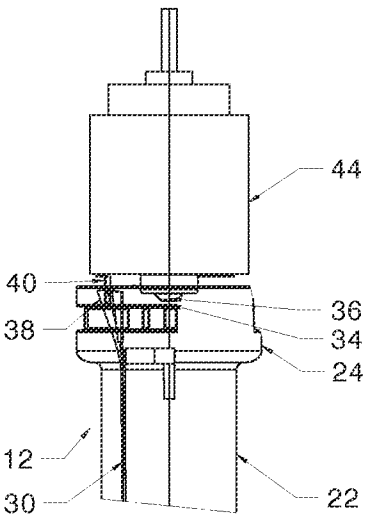
FIG. 3 is a detail showing the motor, connector, a portion of the club shaft and a portion of the battery sleeve with the first coupling element.
Figure 2:
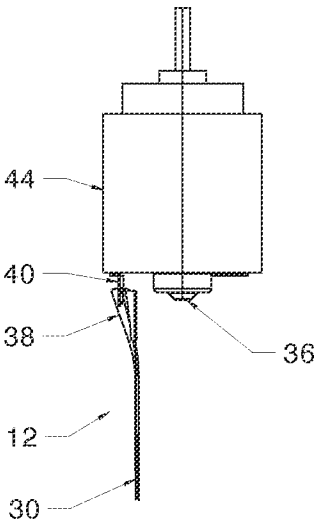
FIG. 2 is a detail showing the motor, connector and a portion of the club shaft.

Example embodiments will now be described more fully with reference to the accompanying drawings.

With reference now to the drawings, a novelty golf club 10 as described herein is in the form of a putter. The golf club 10 has a tubular club shaft 12 with a club head 14 having a faceplate 15 disposed on one end of the shaft and a grip 16 disposed on an end opposite the club head 14. While a putter is shown and described herein, the novelty golf club 10 may take the form of other golf clubs by changing the club head 14 used.

A battery assembly 18 provides DC power and means for coupling with one of an assortment of powered accessories 20 such as a fan assembly 120, a mixer assembly 220, a string trimmer assembly 320, a vibrating massager, a flashlight 520 or a charging unit 620. The battery assembly 18 includes a sleeve 22 sized to fit within the tubular shaft 12. A first coupling element 24 extends from an end of the sleeve 22 on top of the grip end of the shaft 12. A plurality of batteries 26 are arranged end to end in the sleeve 22 and coupled in series so that a positive terminal of the top battery 26.1 is exposed at the first coupling element 24. A spring 28 is disposed at the bottom of the sleeve 22 to bias the batteries upward and to make electrical contact with the negative terminal of the bottom battery 26.6. An electrical connector 30 extends from the spring 28 along the sleeve 22 and terminates adjacent to the positive terminal of the top battery 26.1. As presently preferred, a plurality of batteries includes 6 AAA cell batteries arranged in series to provide a 9V power source. However, one skilled in the art will appreciate that other battery configurations may be used within the spirit and scope of the present disclosure.

Figure 5:
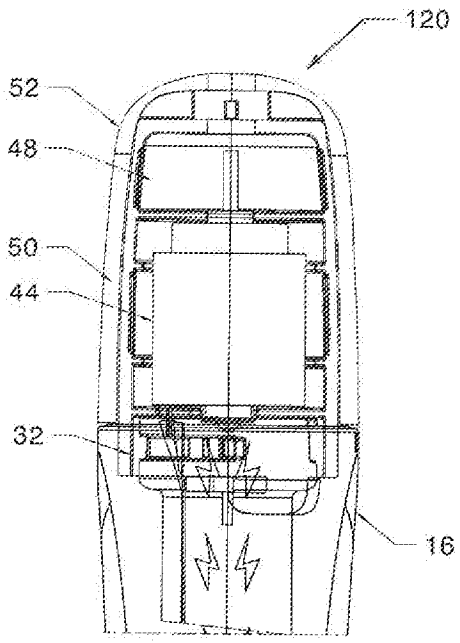
Figure 4:
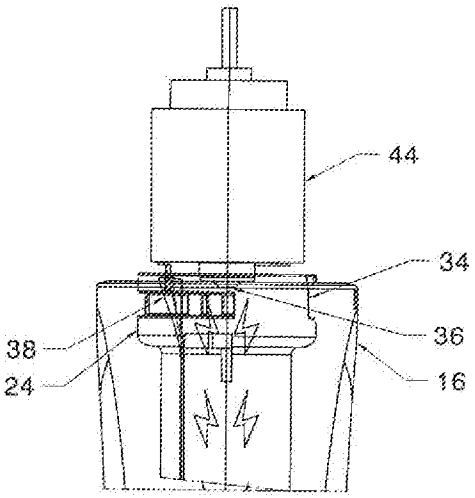
FIG. 4 is a detail similar to FIG. 3 and further illustrating the putter grip.
Figure 7:
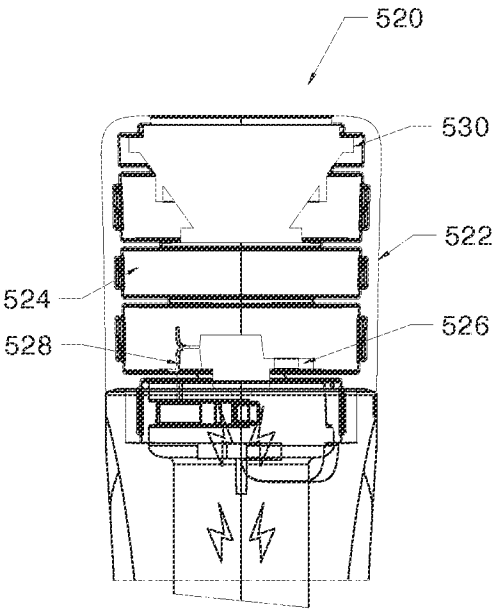
FIG. 7 is a detail similar to FIG. 4 with a powered accessory in the form of a flashlight attached to the first coupling element.
Figure 6:
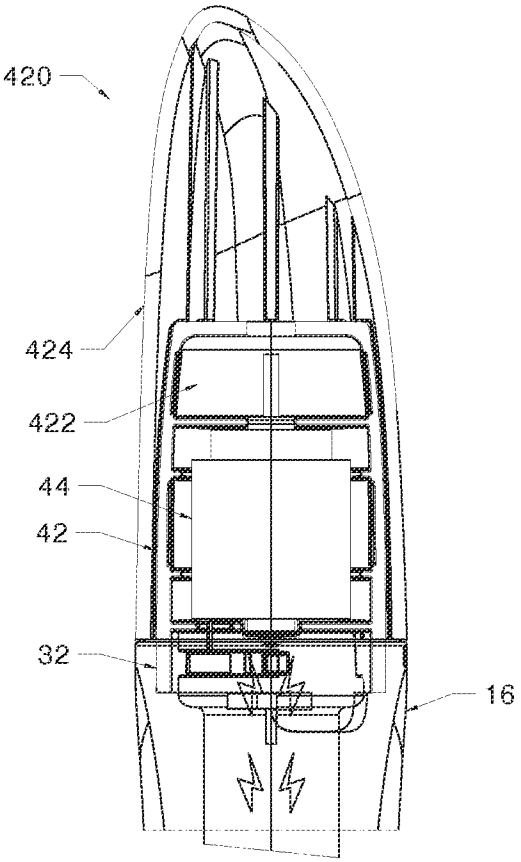
FIG. 6 is a detail similar to FIG. 4 with a powered accessory in the form of a vibrating massager attached to the first coupling element.
Figure 9:
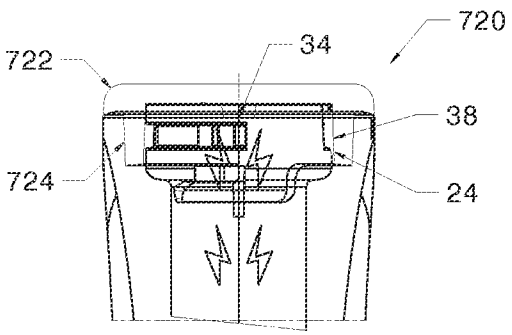
FIG. 9 is a detail similar to FIG. 4 with a play cap installed over the first coupling element.
Figure 8:
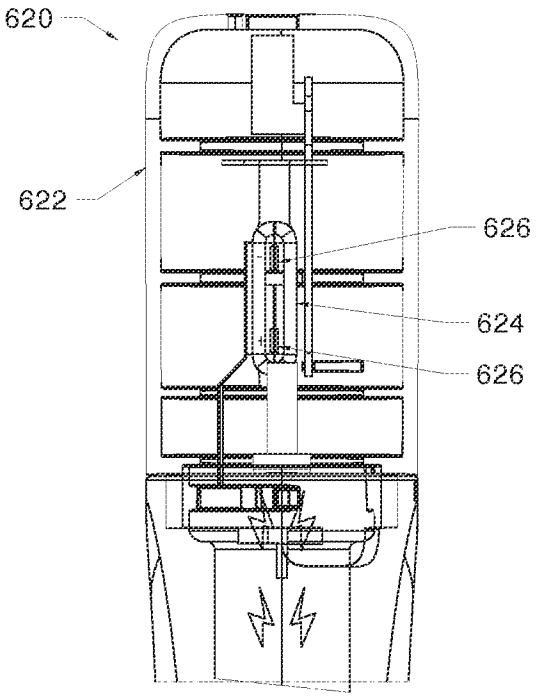
FIG. 8 is a detail similar to FIG. 4 with a powered accessory in the form of a charging unit for a USB-equipped device attached to the first coupling element.

The powered accessory 20 has a second coupling element, for example second coupling element 32 on motorized accessory 120 in FIG. 5, which cooperates with the first coupling element 24 to releasably secure the powered accessory 20 to the battery assembly 18 such that the positive terminal of the top battery 26.1 is in electrical contact with the positive terminal 36 of the powered accessory. When secured together as presently preferred, the first and second coupling element provide a rotary locking mechanism such that relative angular rotation in a first direction through a first range secures the coupling elements 24, 32 together. Relative angular rotation in the first direction through a second range functions to move the negative terminal 38 of the connector 30 into contact with a negative terminal 40 of the powered accessory. In this way, rotation of the powered accessory 20 makes an electrical connection with the plurality of batteries 26 for providing power thereto, and thus functioning as a rotary switch. While a configuration having a rotary switch is presently preferred, one skilled in the art will appreciate that other switch configurations may be used within the spirit and scope of the present disclosure.

The novelty golf club 10 may be equipped with several different powered accessory including motorized power accessories and non-motorized powered accessories. The motorized powered accessories include a fan assembly 120, a mixer assembly 220, a string trimmer assembly 320, and a vibrating massager 420. The non-motorized accessories include a flashlight 520 and a charging unit 620. In addition, the novelty golf club may be equipped with a play cap 720 which cooperates with the first coupling element 24 and covers the battery assembly 18, thereby rendering the golf club functional for use as a putter and legal within the rules of golf. It is further envisioned that multiple powered accessories and/or a play cap would be complied with the battery assembly for marketing and sales as a kit. It is also envisioned that the battery assembly and at least one powered accessory could be assembled with a golf club such as a putter for marketing and sales as a novelty golf club.

The motorized power accessory 20, such as the fan assembly 120, the mixer assembly 220 or the string trimmer assembly 320, includes a motor housing 42 supporting an electric motor 44. An output shaft 46 of the motor 44 provides rotary power for the motorized power accessory. The output shaft 46 may be coupled to a power transmission 48 such as a planetary gear assembly (not shown) for generating the appropriate speed and torque for a given motorized accessory. A spin collar 50 is disposed over the motor housing 42 with the second coupling element 32 formed on the bottom end to releasably couple with the first coupling element 24. A spin cap 52 covers the top of the spin collar 50 and has a hole 54 for accessing the output shaft 46. An upper leather wrap 54 may be secured to the spin collar 50 and a lower leather wrap 56 secured to the grip 16 for providing a uniform gripping surface for the golf club 10.

In a first embodiment, the motorized power accessory 20 takes the form of a fan assembly 120 having a fan cap 122 rotatably supported on top of the spin cap 52. The fan cap 122 has a fan shaft 124 coupled to the output shaft 46. A fan hub 126 is coupled to the fan shaft 124 and has a pair of fan blades 128 extending from the fan hub 126. As presently preferred, the fan blades 128 may be configured to take the form of a pitching wedge blade.

In a second embodiment, the motorized power accessory 20 takes the form of a mixer assembly 220 for stirring cocktails or other beverages. The mixer assembly 220 includes a swizzle stick 222 extending through and rotatably supported by the spin cap 52. The first end of the swizzle stick 222 couples with the output shaft 46. The second end of the swizzle stick 222 has a pair of mixing blades 224 formed thereon. As presently preferred, the mixing blades 224 are configured as a miniature pitching wedge golf club.

In a third embodiment, the motorized power accessory 20 takes the form of a string trimmer assembly 320 for clipping grass. The string trimmer assembly 320 includes a drive shaft 322 having a first end which couples to the output shaft 46. A set of heavy gauge plastic strings 324 extend from the top of the drive shaft 322 to form the string trimmer head.

In a fourth embodiment, the motorized power accessory 20 takes the form of a vibrating massager 420. The vibrating massager 420 includes a vibration mechanism 422 rotatably supported in the motor housing in place of the power transmission. The vibration mechanism 422 uses the rotary power from the motor to generate a vibratory motion. In one form, the vibration mechanism 422 has a weight eccentrically coupled to the output shaft so that the out-of-balance spinning generates the vibratory motion. The vibrating massager 420 further includes a bio-compatible sheath 424 covering the spin collar 50 and spin cap 52. In one form, the sheath 424 may take the form of a human phallus.

The novelty golf club 10 may also include non-motorized powered accessories. In a fifth embodiment, the non-motorized powered accessory is a flashlight 520 having a case 522 with the second coupling element 32 formed therein. A light source 524, preferably in the form of an LED has a first contact element 526 which engages the positive terminal 34 of the battery assembly 18, and second contact element 528 adapted to selectively couple with the negative terminal 38 for turning the flashlight on and off. As presently preferred, the flashlight uses a rotary switching mechanism as described above with respect to the second coupling element 32. A translucent lens 530 is secured to the case and covers the light source 524.

In a sixth embodiment, the non-motorized powered accessory is a charging unit having a case 622 with the second coupling element 32 formed therein. A charging port 624 has a female connector 626 with a first contact 628 electrically coupled to the positive terminal 34 and a second contact 628 electrically coupled to the negative terminal 38 when the charging unit 620 is attached to the battery assembly 18. In one form, the charging port is configured with a female USB-type connector for charging mobile phones, tablet, personal audio devices and other consumer electronics. An adapter charging cord (not shown) having a complementary male USB-type connector on one end and one or more standard charging plugs on a second end may also be provided. Alternately, the charging ports may be configured as other standard female charging ports.

As noted above, the novelty golf club 10 may further include a play cap 720 which covers the end of the grip 16 making the putter usable as a golf club. The play cap 720 has a body 722 with a third coupling element 724 formed therein. The third coupling element 724 which cooperates with the first coupling element 24 to cover the battery assembly when a powered accessory is not in place. The body 722 insulates the positive terminal 34 from the negative terminal 38 to ensure that the battery assembly 18 will not short-circuit.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure. Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

What is claimed is:

1. A novelty golf club comprising:

a golf club including a tubular shaft having a golf club head disposed on a club end of the tubular shaft and a grip disposed on a grip end of the tubular shaft opposite the club head;

a battery assembly including:

a sleeve disposed within the tubular shaft and having a first coupling element abutting a terminal end of the tubular shaft at the grip end and extending beyond the terminal end of the tubular shaft;

at least one battery arranged in the sleeve so that a first terminal is exposed at the first coupling element;

an electrical connector in contact with a second terminal of the at least one battery and terminating adjacent to the first terminal; and a powered accessory having a second coupling element which directly engages the first coupling element to releasably secure and operably couple the powered accessory to the battery assembly such that rotation of the powered accessory relative to the battery assembly makes an electrical connection between the first and second terminals on the battery assembly and first and second contact elements on the powered accessory for providing power thereto.

2. The novelty golf club of claim 1 further comprising a cap having a third coupling element which directly engages the first coupling element to cover the battery assembly and insulate the positive terminal from the negative terminal when a powered accessory is not in place.

3. The novelty golf club of claim 1 wherein the powered accessory includes a motor housing and an electric motor disposed within the motor housing and having an output shaft transmitting rotary power therefrom.

4. The novelty golf club of claim 3 further comprising a fan assembly including a fan cap rotatably supported on top of the motor housing, the fan cap having a fan shaft coupled to the output shaft, a fan hub coupled to the fan shaft and at least two fan blades extending from the fan hub.

5. The novelty golf club of claim 3 further comprising a mixer assembly including a spin cap rotatably supported on top of the motor housing and a swizzle stick extending through and rotatably supported by the spin cap, wherein the swizzle stick has a first end adapted to couple with the output shaft and a second end with a mixing blade formed thereon.

6. The novelty golf club of claim 3 further comprising a string trimmer assembly including a spin cap rotatably supported on top of the motor housing and a string trimmer extending through and rotatably supported by the spin cap, wherein the string trimmer has a first end adapted to couple with the output shaft and a second end with a heavy gauge plastic string extending therefrom.

7. The novelty golf club of claim 3 further comprising a vibrating massager including a vibration mechanism rotatably supported on the motor housing, the vibration mechanism having a weight eccentrically coupled to the output shaft and a bio-compatible sheath covering the motor housing and the vibration mechanism such that rotation of the weight generates a vibration which is transmitted through the sheath.

8. The novelty golf club of claim 1 wherein the powered accessory further comprises a flashlight having a case with the second coupling element formed therein, a light source having first and second contact elements adapted to couple with the positive and negative terminals, and a translucent lens secured to the case and covering the light source.

9. The novelty golf club of claim 1 wherein the powered accessory further comprises a charging unit including a case supporting the second coupling element and a charging port, the charging port having a female connector with a first contact electrically coupled to the positive terminal and a second contact electrically coupled to the negative terminal when the powered accessory is attached to the battery assembly.

10. A golf club accessory comprising:

a battery assembly including:

a sleeve having a first coupling element formed on a first end thereof, wherein the sleeve is configured to be disposed within a grip end of a golf club shaft opposite a golf club head end, the first coupling element having a shoulder configured to abut a terminal end of the shaft at the grip end such that the first coupling element is configured to extend beyond the terminal end;

at least one battery arranged in the sleeve so that a first terminal is exposed at the first coupling element;

an electrical connector in contact with a second terminal and terminating adjacent to the first terminal; and a powered accessory having a second coupling element which directly engages the first coupling element to releasably secure and operably couple the powered accessory to the battery assembly such that rotation of the powered accessory relative to the battery assembly makes an electrical connection between the first and second terminals on the battery assembly and first and second contact elements on the powered accessory for providing power thereto.

11. The golf club accessory of claim 10 further comprising a cap having a third coupling element which directly engages the first coupling element to cover the battery assembly and insulate the positive terminal from the negative terminal when a powered accessory is not in place.

12. The golf club accessory of claim 10 wherein the powered accessory includes a motor housing and an electric motor disposed within the motor housing and having an output shaft transmitting rotary power therefrom.

13. The golf club accessory of claim 12 further comprising a fan assembly including a fan cap rotatably supported on top of the motor housing, the fan cap having a fan shaft coupled to the output shaft, a fan hub coupled to the fan shaft and at least two fan blades extending from the fan hub.

14. The golf club accessory of claim 12 further comprising a mixer assembly including a spin cap rotatably supported on top of the motor housing and a swizzle stick extending through and rotatably supported by the spin cap, wherein the swizzle stick has a first end adapted to couple with the output shaft and a second end with a mixing blade formed thereon.

15. The golf club accessory of claim 14 wherein the mixing blade include a pair of mixing blades, each configured as a miniature pitching wedge golf club.

16. The golf club accessory of claim 12 further comprising a string trimmer assembly including a spin cap rotatably supported on top of the motor housing and a string trimmer extending through and rotatably supported by the spin cap, wherein the string trimmer has a first end adapted to couple with the output shaft and a second end with a heavy gauge plastic string extending therefrom.

17. The golf club accessory of claim 12 further comprising a vibrating massager including a vibration mechanism rotatably supported on the motor housing, the vibration mechanism having a weight eccentrically coupled to the output shaft and a bio-compatible sheath covering the motor housing and the vibration mechanism such that rotation of the weight generates a vibration which is transmitted through the sheath.

18. The golf club accessory of claim 10 wherein the powered accessory further comprises a flashlight having a case with the second coupling element formed therein, a light source having first and second contact elements adapted to couple with the positive and negative terminals, and a translucent lens secured to the case and covering the light source.

19. The golf club accessory of claim 10 wherein the powered accessory further comprises a charging unit including a case supporting the second coupling element and a charging port, the charging port having a female connector with a first contact electrically coupled to the positive terminal and a second contact electrically coupled to the negative terminal when the powered accessory is attached to the battery assembly.

20. A golf club accessory comprising:

a battery assembly including:

a sleeve having a first coupling element formed on a first end thereof, wherein the sleeve is configured to be disposed within a golf club shaft such that the first coupling element extends from a grip end of the shaft opposite a club end;

at least one battery arranged in the sleeve so that a first terminal is exposed at the first coupling element;

an electrical connector in contact with a second terminal and terminating adjacent to the first terminal; and an accessory kit including:

at least one powered accessory selected from the group consisting of a fan assembly, a mixer assembly, a string trimmer assembly, a vibrating massager, a flashlight, a charging unit, and combinations thereof, wherein the at least one powered accessory has a second coupling element which directly engages the first coupling element to releasably secure and operably couple the powered accessory to the battery assembly such that rotation of the powered accessory relative to the battery assembly makes an electrical connection between the first and second terminals on the battery assembly and first and second contact elements on the powered accessory for providing power thereto; and a cap having a third coupling element which directly engages the first coupling element to cover the battery assembly and insulate the positive terminal from the negative terminal when a powered accessory is not in place.

* * * * *